US007460798B2

(12) United States Patent
Toda et al.

(10) Patent No.: US 7,460,798 B2
(45) Date of Patent: Dec. 2, 2008

(54) IMAGE FORMING APPARATUS AND METHOD OF DETECTING AMOUNT OF RESIDUAL DEVELOPER

(75) Inventors: Atsushi Toda, Mishima (JP); Takeo Shoji, Shizuoka-ken (JP); Satoshi Sunahara, Shizuoka-ken (JP); Hideaki Hasegawa, Meridian, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 312 days.

(21) Appl. No.: 11/228,327

(22) Filed: Sep. 19, 2005

(65) Prior Publication Data

US 2006/0067718 A1 Mar. 30, 2006

(30) Foreign Application Priority Data

Sep. 30, 2004 (JP) ..... 2004-289220
Sep. 9, 2005 (JP) ..... 2005-262974

(51) Int. Cl.
*G03G 15/08* (2006.01)

(52) U.S. Cl. ..... 399/27; 399/30; 399/279; 399/285

(58) Field of Classification Search ..... 399/27, 399/30, 279, 285
See application file for complete search history.

(56) References Cited

U.S. PATENT DOCUMENTS 5,470,635 A 11/1995 Shirai et al. ..... 428/131
5,835,818 A 11/1998 Hoshika et al. ..... 399/26
5,937,228 A * 8/1999 Shoji et al. ..... 399/55
6,415,112 B1 7/2002 Kimizuka et al. ..... 399/27
6,535,699 B1 3/2003 Abe et al. ..... 399/27
6,591,070 B1 7/2003 Shoji et al. ..... 399/27
6,661,980 B2 12/2003 Matsumoto et al. ..... 399/27
6,836,639 B2 12/2004 Karakama et al. ..... 399/351
6,882,806 B2 4/2005 Sunahara et al. ..... 399/50
6,892,035 B2 5/2005 Matsumoto et al. ..... 399/27
6,947,678 B2 9/2005 Ohtomo et al. ..... 399/27
6,970,661 B2 11/2005 Shoji ..... 399/50
7,035,560 B2 4/2006 Okano et al. ..... 399/50

(Continued)

FOREIGN PATENT DOCUMENTS

CN 1335540 2/2002

(Continued)

OTHER PUBLICATIONS

Chinese Office Action for Application No. 2005101051868 issued Nov. 30, 2007.

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

An image forming apparatus has a developer container containing a developer and a developer carrying member for carrying the developer and adapted to switch an AC voltage to be applied to the developer carrying member. The apparatus includes a detecting member for detecting the amount of developer in the developer container and a processing portion for determining the amount of developer in the developer container according to the value output by the detecting member when the AC voltage is applied to the developer carrying member. The processing portion is adapted to determine the amount of developer by executing a process that corresponds to the operation of switching the AC voltage.

9 Claims, 13 Drawing Sheets

U.S. PATENT DOCUMENTS

| | | | | |
|---|---|---|---|---|
| 2005/0175366 | A1 | 8/2005 | Hasegawa et al. | 399/50 |
| 2005/0271406 | A1 | 12/2005 | Okano et al. | 399/50 |
| 2006/0067718 | A1 | 3/2006 | Toda et al. | 399/27 |
| 2006/0109491 | A1 | 5/2006 | Naito et al. | 358/1.13 |
| 2006/0181726 | A1 | 8/2006 | Naito et al. | 358/1.14 |

FOREIGN PATENT DOCUMENTS

| | | |
|---|---|---|
| CN | 1444106 | 9/2003 |
| JP | 2000-206774 A | 7/2000 |
| JP | 2002-244365 | 8/2002 |
| JP | 2003-307994 | 10/2003 |

* cited by examiner

IMAGE FORMING APPARATUS AND METHOD OF DETECTING AMOUNT OF RESIDUAL DEVELOPER

BACKGROUND OF THE INVENTION

1. Field of the Invention

This invention relates to an image forming apparatus for forming an electrostatic latent image on an image bearing member by electrophotography and visualizing the electrostatic latent image by means of a developer and also to a method of detecting the amount of residual developer. More particularly, the present invention relates to an electrophotographic image forming apparatus having means for detecting the amount of residual developer adapted to iteratively detect the amount of residual developer contained in the developing apparatus or the process cartridge of the image forming apparatus and also to a method of detecting the amount of residual developer.

For the purpose of the present invention, electrophotographic image forming apparatus include electrophotographic copying machines, electrophotographic printers (LED printers, laser beam printers and so on) and electrophotographic facsimile machines. For the purpose of the present invention, a process cartridge refers to a combination of at least a charging means, a developing apparatus or a cleaning means and an electrophotographic photosensitive member that operates as an image bearing member integrally put into a cartridge, which cartridge is detachably mountable to the electrophotographic image forming apparatus main body. A process cartridge refers at least to a combination of a developing apparatus and an electrophotographic photosensitive member that are integrally put into a cartridge, which cartridge is detachably mountable to the electrophotographic image forming apparatus main body.

2. Related Background Art

Defective images such as low optical density images and/or lost images can appear when an electrophotographic image forming apparatus, which may be a laser printer, becomes short of developer (e.g., toner) in operation. Therefore, conventionally, the amount of residual developer (toner) is detected normally in the developing apparatus. Existing electrophotographic image forming apparatus are equipped with means for displaying an indication that or a warning that there is a toner shortage, which means is operated when such a shortage arises so that toner may be supplied (or replenished) before defective images appear.

For the purpose of supplying toner, the developer containing portion of the image forming apparatus that contains toner is realized in the form of a cartridge so that toner may be supplied by replacing the cartridge. Additionally, an arrangement of combining the developer containing portion that also operates as a developing apparatus and the electrophotographic photosensitive member that is an image bearing member and putting them into a cartridge, which is referred to as a process cartridge and detachably mountable to the image forming apparatus, is being used popularly.

As means for detecting the amount of residual developer for detecting the amount of residual toner in the developing apparatus, those of the electrostatic capacity detection type are known (see, Japanese Patent Application Laid-open No. 2000-206774).

FIG. 14 of the accompanying drawings schematically illustrates a developing apparatus equipped with a means for detecting the amount of residual developer of the electrostatic capacity detection type.

Referring to FIG. 14, the developing apparatus 4 comprises a developing sleeve 43 that is an electroconductive cylindrical member adapted to operate as developer carrying member. A plate antenna PA, which is an electroconductive detecting member, is arranged in developer containing portion 40 with toner interposed between itself and the developing sleeve 43. When detecting the amount of residual toner in the developing apparatus 4, the developing sleeve 43 and the plate antenna PA are operated as electrodes and the change in the electrostatic capacity between the two electrodes, or the developing sleeve 43 and the plate antenna PA, that is observed when a developing bias is applied to the developing sleeve 43 represents the change in the amount of residual toner existing between the developing sleeve 43 and the plate antenna PA in order to detect the amount of residual toner.

The electrostatic capacity between the developing sleeve 43 and the plate antenna PA is observed by applying a developing bias, that is an oscillating voltage formed by superimposing an AC voltage on a DC voltage, to the developing sleeve 43 from a developing bias source (not shown) and converting the electric current flowing between the plate antenna PA and the ground into a DC voltage by means of a detection circuit. In other words, the electrostatic capacity is read as the value of the induced voltage that is generated between the two electrodes, which are the developing sleeve 43 and the plate antenna PA.

However, the value of the developing bias that is applied to the developer carrying member, which is typically a developing sleeve 43 as shown in FIG. 14, is more often than not selected so as to be able to achieve the best image quality even when the developing bias is used in order to detect the amount of residual toner in the developing apparatus.

On the other hand, the developing apparatus is arranged in the process cartridge and, in many cases, the latter is replaced by a new one when toner is in short supply. If the developing bias that is held to a single constant value is used to detect the amount of residual toner in the developing apparatus, it has become increasingly difficult to accurately detect the amount of residual toner in order to achieve the best image quality all the way from the very start to the end of the service life of the process cartridge because of the current trend of prolonged service life of process cartridges.

In view of the above, Japanese Patent Application Laid-open No. 2002-244365 proposes a technique of defining the developing bias according to the environment and the amount of residual toner in an image forming apparatus in order to achieve the best image quality all the way from the very start to the end of the service life of the process cartridge. With the proposed technique, it is possible to constantly produce a high quality image by appropriately switching the amplitude of the AC voltage, which forms the developing bias with a DC voltage, or reducing the amplitude of the developing bias as a function of the time spent in service to be more accurate.

It has been found that the optical density of the produced image falls remarkably particularly in a latter half of the service life of the process cartridge when it is put to use in a hot and highly humid environment. With the proposed technique, the problem of a defective image with a low optical density may be dissolved by raising the amplitude of the AC voltage of the developing bias.

However, if the amplitude of the AC voltage of the developing bias is raised in a cold and low humidity environment and/or from the initial stages of the service life of the process cartridge, particles of developer can be driven to fly and land on a non-image area where no image is supposed to be formed to produce a defective image as shown in FIG. 15A relative to a normal image shown in FIG. 15B. Such a phenomenon is referred to as "fog".

Thus, the measure to be taken for achieving the best image quality may be to select an appropriate value for the amplitude of the AC voltage depending on the environment in such a way that a small value is used for the AC voltage in a cool and low humidity environment or in an environment that is hot and humid but no fog would occur particularly or in the initial stages of the service life of the process cartridge but a large value is used for the AC voltage in the latter stages of the service life of the process cartridge. In other words, the amplitude of the AC voltage of the developing bias needs to be switched depending on the environment and the amount of residual toner in the developing apparatus.

As such a measure, Japanese Patent Application Laid-open No. 2003-307994 discloses a technique of providing two image forming modes including the first image forming mode where the amplitude of the AC voltage of the developing bias is defined for the initial stages of the service life of the process cartridge so as to solve the problem of degraded images, such as foggy images, and realize the best image quality printing and the second image forming mode where the amplitude of the AC voltage of the developing bias is so defined as to prevent images of low optical density from being produced when the amount of residual toner is reduced in a latter half of the service life of the process cartridge. The first image forming mode is switched to the second image forming mode at the middle of the service life of the cartridge.

However, the above-described arrangement for selecting the amplitude of the AC voltage of the developing bias out of a plurality of values depending on the selected image forming mode entails problems including that the area and the cost required for necessary circuits will be significant and that the output value of the circuit for detecting the amount of residual toner, or the means for detecting the amount of residual toner, by means of the developing bias can show discrepancies, thereby remarkably lowering the accuracy of the result of residual toner detecting process.

For instance, assume an arrangement where two image forming modes are provided so as to be switched from one to the other as a function of the surrounding environment and the amount of residual toner in the developing apparatus. Then, if the amplitude of the AC voltage of the developing bias before a switch is 2.0 KV and the amplitude of the AC voltage of the developing bias after the switch is 2.5 KV, the relationship between the amount of residual toner and the detection output value on the amount of residual toner is typically expressed by the solid line in the graph of FIG. 5, where the detection output value on the amount of residual toner changes abruptly when the image forming mode is switched from one to the other.

Referring to FIG. 5, 3 V is selected for the output voltage at which a toner shortage is judged to take place because defective images are produced owing to shortage of toner when the detection output value on the amount of residual toner is equal to or greater than 3 V while the amplitude of the AC voltage of the developing bias is 2.0 KV. If the amplitude of the AC voltage of the developing bias is switched from 2.0 KV to 2.5 KV when the amount of residual toner is equal to or less than 20% of the capacity in a hot and highly humid environment of the image forming apparatus, the detection output value on the amount of residual toner falls from 2.45 V to 2.1 V so that the detection output value on the amount of residual toner will be less than 3 V if the amount of residual toner is 0% of the capacity. In other words, no toner shortage is judged to take place although there is no toner left. Then, the image forming operation will be continued in a state of toner shortage to consequently give rise to defective images.

In short, with the above-described arrangement of detecting the amount of residual developer in the developing apparatus by way of the dielectric voltage that is generated between the electrodes arranged in the developer containing portion of the developing apparatus by the developing bias formed by laying an AC voltage on a DC voltage so as to be applied to the developer carrying member, there arise a problem that the amount of residual toner in the developing apparatus can be detected falsely due to the discrepancy between the detected values for the amount of residual developer before and after a switch of the amplitude of the AC component of the developing bias.

SUMMARY OF THE INVENTION

Thus, it is an object of the present invention to solve the above-identified technical problems of the prior art by providing an image forming apparatus and a method of detecting the amount of residual developer that can accurately detect the amount of residual developer even when the amplitude of the AC component of the developing bias is switched. Another object of the present invention is to provide an image forming apparatus and a method of detecting the amount of residual developer that can accurately detect the amount of residual developer to form excellent images with an arrangement of switching the amplitude of the AC voltage of the developing bias to be applied to the developer carrying member as a function of the surrounding environment of the image forming apparatus and the amount of residual developer without being influenced by the switch of the amplitude.

According to an aspect of the present invention the above objects are achieved by providing an image forming apparatus having a developer container containing a developer and a developer carrying member for carrying the developer and adapted to switch an AC voltage to be applied to the developer carrying member, the apparatus comprising: a detecting member for detecting the amount of developer in the developer container; and a processing portion for determining the amount of developer in the developer container according to the value output by the detecting member when the AC voltage is applied to the developer carrying member; wherein the processing portion determines the amount of developer by executing a process that corresponds to the operation of switching the AC voltage.

Accordingly to another aspect of the present invention, there is provided a method of detecting the amount of residual developer in an image forming apparatus having a developer container containing a developer and a developer carrying member for carrying the developer and adapted to switch an AC voltage to be applied to the developer carrying member, the method comprising: a detecting step of detecting the amount of developer in the developer container at the time of applying the AC voltage to the developer carrying member; and a processing step of determining the amount of developer by executing a process that corresponds to the operation of switching the AC voltage.

Further objects of the present invention will become apparent from the detailed description of the present invention given below by referring to the accompanying drawings.

DESCRIPTION OF THE PREFERRED EMBODIMENTS

Now, an image forming apparatus and a method of detecting the amount of residual developer according to the invention will be described in greater detail by referring to the accompanying drawings.

Embodiment 1

Figure 1:
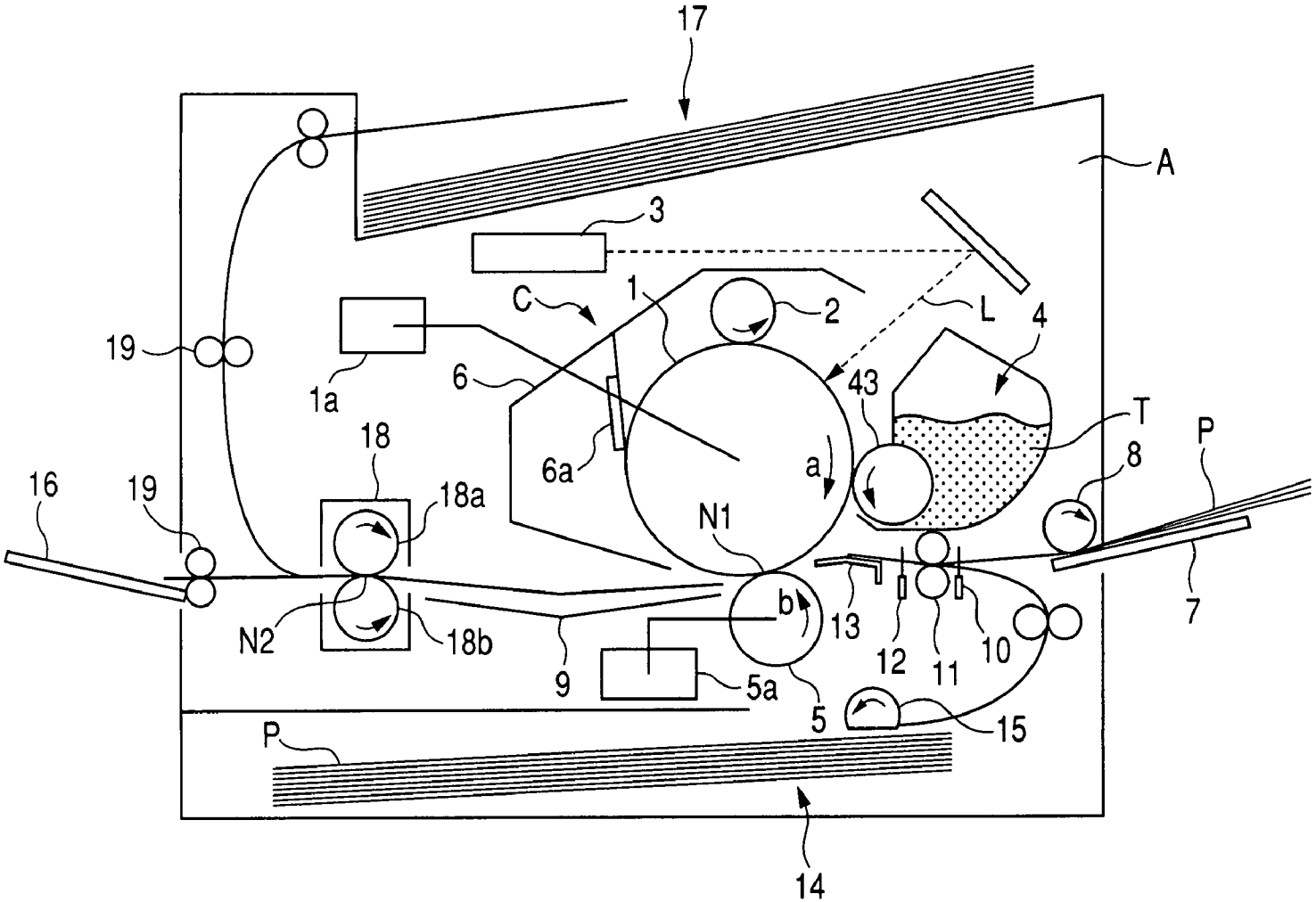
FIG. 1 is a schematic illustration of an embodiment of image forming apparatus according to the invention, showing the configuration thereof.

FIG. 1 is a schematic illustration of an embodiment of image forming apparatus according to the invention, showing the configuration thereof. This embodiment of image forming apparatus is an electrophotographic laser beam printer comprising a drum-shaped electrophotographic photosensitive member, or photosensitive drum 1, that operates as an image bearing member.

The photosensitive drum 1 is prepared by forming a photosensitive material such as OPC or amorphous Si on a cylindrical substrate that is typically made of aluminum or nickel so as to be driven to rotate by a drive means 1*a* at a predetermined rotary speed in a clockwise direction as indicated by arrow a in FIG. 1.

A charging means 2 is arranged at a peripheral position of the rotating photosensitive drum 1 in order to uniformly electrically charge the peripheral surface of the photosensitive drum 1 to make it assume a predetermined polarity and a predetermined electric potential. The charging means 2 of this embodiment is a contact type charging device having a charging roller 2. The embodiment also comprises an image information exposing means, which is a laser beam scanner 3 having a semiconductor laser, a polygon mirror, an F-θ lens and so on in this embodiment. The laser beam scanner 3 emits a laser beam L, which is controlled to turn ON/OFF according to the image information transmitted from a host apparatus (not shown), to scan the surface of the photosensitive drum 1 that is uniformly electrically charged by the charging roller 2 and form an electrostatic latent image there.

At a downstream position relative to the position for irradiating a laser beam L of the laser beam scanner 3 as viewed in the rotary direction of the photosensitive drum 1, a developing apparatus for developing the electrostatic latent image on the photosensitive drum 1 is arranged to produce a developer image (toner image). The developing apparatus will be described in greater detail hereinafter.

The developing apparatus 4 may be used with a jumping developing method or a two-component developing method. A combination of image exposure and reversal developing is used for it.

A transferring roller 5 that has a profile of a rotary member having a resilient layer and operates as a contact type charging member is arranged at a downstream position relative to the developing apparatus 4 as viewed in the rotary direction of the photosensitive drum 1 to form a transfer nip portion N1 that is held in contact with the photosensitive drum 1 to apply pressure to the latter. It is driven to rotate by the drive means 5*a* at a predetermined rotary speed in a counterclockwise direction as indicated by arrow b.

A recording material P is fed from a sheet feeding portion, which may be a manual sheet feeding portion 7 or a cassette sheet feeding portion 14, and held in a standby state at pre-feed sensor 10. Then, the recording material P is forced to pass through a registration roller 11, a registration sensor 12 and a pre-transfer guide 13 and fed to the transfer nip portion N1. Thus, the recording material P is fed to the transfer nip portion N1 that is formed by the photosensitive drum 1 and the transferring roller 5 by the registration sensor 12 synchronously with the toner image formed on the surface of the photosensitive drum 1. The sheet feeding portions 7, 14 are provided with respective separation rollers 8, 15 and so on in order to avoid the problem of erroneously double feeding a plurality of recording materials P at one time at the sheet feeding portions 7, 14.

The toner image formed on the photosensitive drum 1 is gradually electrostatically transferred on the recording material P fed from the sheet feeding portion 7 or 14 at the transfer nip portion N1.

The recording material P, on which the toner image is transferred at the transfer nip portion N1, passes through the transfer nip portion N1 and becomes separated from the peripheral surface of the photosensitive drum 1 and then conveyed to fixing apparatus 18 by way of a sheet path 9.

In this embodiment, the fixing apparatus 18 is of the film heating type that is formed by a pair of press-contacting rollers including a heating film portion 18*a* and a pressure roller 18*b*. The toner image is fixed to the surface of the recording material P to become a permanent image as the recording material P that is holding the toner image is pinched and conveyed at fixing nip portion N2, which is a press-contacting portion formed by the heating film portion 18*a* and the pressure roller 18*b*, so as to be subjected to heat and pressure.

The recording material P to the surface of which the toner image is fixed is then discharged by a sheet discharging roller 19 to discharged sheet receiver 16 or 17 face-up or face-down, whichever is appropriate, as the image formation product.

Meanwhile, after transferring the toner image onto the recording material P, the photosensitive drum 1 is cleaned along the surface thereof by a cleaning apparatus 6 to remove the untransferred residual toner so that it may serve for image forming operations repeatedly. The cleaning apparatus 6 of this embodiment is a blade cleaning apparatus having a cleaning blade 6*a* that is held in contact with the photosensitive drum 1.

The electrophotographic image forming apparatus of this embodiment is a laser beam printer adapted to receive image information from a host computer and output a visualized image. The electrophotographic photosensitive member, which is the photosensitive drum 1, the developing apparatus 4 containing developer (toner) and other consumables are integrally put into a cartridge as described above and the cartridge is detachably mounted to the apparatus main body A as process cartridge C.

Figure 2:
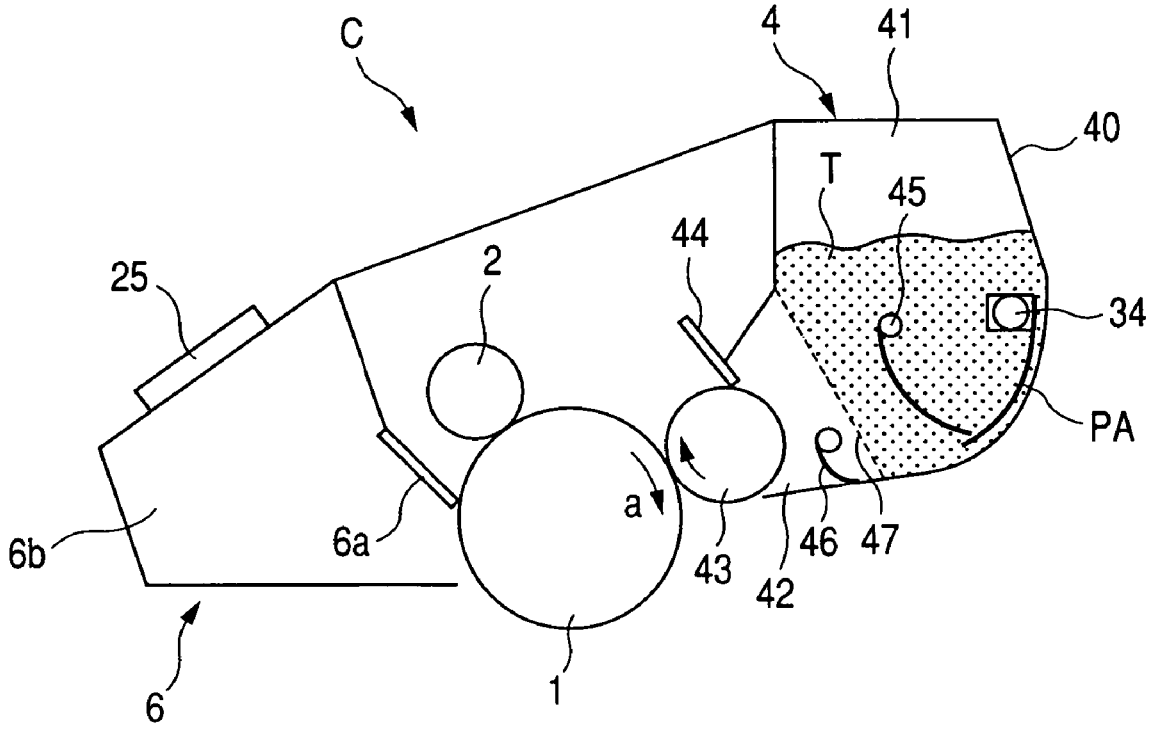
FIG. 2 is a schematic illustration of a process cartridge that can be used for the purpose of the present invention.

Now, the process cartridge C of this embodiment will be described in greater detail by referring to FIG. 2. As shown in FIG. 2, the process cartridge C is formed by integrally combining the photosensitive drum 1, which is an electrophotographic photosensitive member, the charging roller 2 that operates as charging means for uniformly charging the photosensitive drum 1 with electricity, the developing apparatus 4, the cleaning blade 6*a* of the cleaning apparatus 6 for cleaning the surface of the photosensitive drum 1, and a waste toner container 6*b* for containing the residual toner removed from the photosensitive drum 1 by the cleaning blade 6*a*. The process cartridge C is detachably mounted to the main body A of the electrophotographic image forming apparatus.

The developing apparatus 4 arranged in the process cartridge C contains developer T. More specifically, it has a developer containing portion 40 that contains developer T.

An insulating magnetic one-component developer (toner) is used as developer of this embodiment.

The laser beam printer of this embodiment is provided with means for detecting the amount of residual developer 100 (FIG. 3) that can iteratively detect the amount of residual toner if toner is consumed.

Now, the developing apparatus 4 and the means for detecting the amount of residual developer 100 of the process cartridge C will be described in greater detail.

The developing apparatus 4 comprises a toner containing section 41 for containing magnetic one-component developer (to be referred to as toner hereinafter) T, a developing portion 42 linked to the toner containing section 41, a developing sleeve 43 that is a developer carrying member as a developing means arranged vis-à-vis the photosensitive drum 1 in the developing portion 42, a developing blade 44 that is a developer regulating member adapted to contact the developing sleeve 43 and regulate the thickness of the toner layer to be conveyed by the developing sleeve 43, an agitating member 45 for agitating the toner in the toner containing section 41 and feeding toner into the developing portion 42 and another agitating member 46 for agitating the toner in the developing portion 42 and feeding toner to the developing sleeve 43.

Thus, in this embodiment, toner T can be contained both in the toner containing portion 41 and the developing portion 42. In other words, a developer containing portion 40 is formed by the toner containing portion 41 and the developing portion 42. Before the process cartridge C is put to use, a toner sealing member 47 is bonded to a position disposed between the toner containing portion 41 and the developing portion 42 in the developer containing portion 40. The toner sealing member 47 is arranged in such a way that toner would not leak if the process cartridge C is subjected to a violent impact while it is being transported. The toner sealing member 47 is torn off by a user immediately before the process cartridge C is mounted in the apparatus main body A.

After the sealing member 47 is torn off, the process cartridge C feeds toner T from the inside of the toner containing portion 41 to the developing portion 42, while agitating the toner contained in the toner containing portion 41 by means of the agitating member 45. The developing portion 42, which is a developing means, supports the developing sleeve 43 that is a non-magnetic sleeve containing a fixed magnet roll (not shown) as a magnetic field generating means so as to allow it to rotate in a forward direction that is the rotary direction a of the photosensitive drum 1. As the developing sleeve 43 rotates, the layer of the toner T that is being conveyed on the developing sleeve 43 is regulated for its thickness and a triboelectric charge is applied to it.

The toner T that is conveyed to a part (developing region) located vis-à-vis the photosensitive drum 1 by the rotating developing sleeve 43 is transferred onto the photosensitive drum 1 according to the electrostatic latent image formed on the photosensitive drum 1 by the developing bias applied to the developing sleeve 43 at the time of the developing process. In this embodiment, a developing bias formed by superimposing an AC voltage on a DC voltage is applied from a developing bias applying means 35 (FIG. 3) that is a bias applying circuit to the developing sleeve 43.

As shown in FIG. 2, means for detecting the amount of residual developer 100 of the electrostatic capacity detection type that is adapted to detect the amount of residual toner by means of a plate antenna is used in this embodiment. More specifically, the means for detecting the amount of residual developer 100 is formed by using the developing sleeve 43 arranged in the developing portion 42 as one of the electrodes and a plate antenna PA that is an electroconductive plate arranged in the developer containing portion 40, or the toner containing portion 41 in this embodiment, as the electrode opposite to the developing sleeve 43. Toner T is contained in a space defined by the developing sleeve 43 and the plate antenna PA. The plate antenna PA and the developing sleeve 43 form a capacitor structure with each other.

However, it should be noted that an electrode member for forming a capacitor structure with the developing sleeve 43 is not limited to a plate antenna PA and some other electroconductive member may be used in combination with the developing sleeve 43 so long as it operates as electrode for using an electrostatic capacity.

The plate antenna PA of this embodiment is arranged specifically in the toner containing portion 41, in which toner T is held mobile, in the developer containing portion 40 so that the degree of reduction of the amount of toner T may be directly observable as shown in FIG. 2. While the plate antenna PA may be made of any material so long as the material is electrically highly conductive and can take a shape of plate, it is desirably made of a material that does not adversely affect toner particles and can withstand environmental conditions including humidity when it is arranged in the toner containing portion 41. The plate antenna PA is made to take such a shape that it can be electrically energized along a lateral surface thereof. The plate antenna PA may be directly connected to a conductor at the electrically connectable spot or receive an electrically conductive pin pierced into it from a lateral surface of the cartridge C. In this embodiment, a pin is pieced into a rising portion 34 of the plate antenna PA by way of a lateral wall of the cartridge C.

The amount of residual toner is detected by the developing sleeve 43 and the plate antenna PA as a bias (detection bias) formed by superimposing an AC voltage on a DC voltage, which is a developing bias in this embodiment, is applied to the developing sleeve 43.

In other words, the means for detecting the amount of residual developer 100 is adapted to read the value of the voltage induced at the plate antenna PA by the developing bias applied to the developing sleeve 43. Since the dielectric constant of the toner changes as a function of the amount of residual toner between the developing sleeve 43 and the plate antenna PA, the value of the voltage induced at the plate antenna PA also changes as a function of the amount of residual toner. Thus, the amount of residual developer (toner) is detected by reading the value of the inducted voltage.

Now, the circuit configuration of the means for detecting the amount of residual developer 100 of this embodiment will be described by referring to FIG. 3.

The apparatus main body A and the cartridge C are provided respectively with electric contacts (not shown) so that the plate antenna PA of the cartridge C and toner residual amount detecting portion 37 of the apparatus main body A are electrically connected by way of the electric contacts when the cartridge C is mounted in the apparatus main body A.

Figure 3:
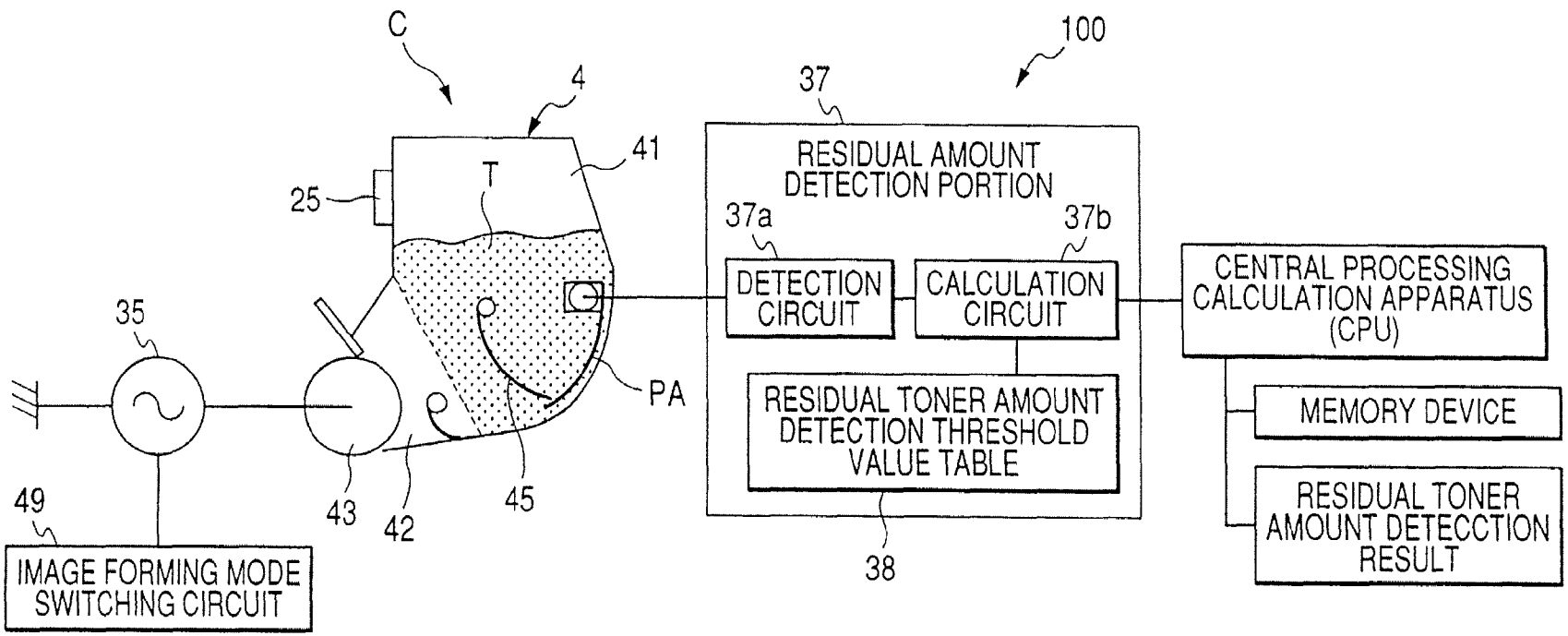
FIG. 3 is a schematic circuit diagram of means for detecting the amount of residual developer that can be used for the purpose of the present invention.

Referring to FIG. 3, as a predetermined AC bias is output from developing bias source 35, which is a developing bias applying means, the bias is applied to the developing sleeve 43. Then, the value of the inducted voltage generated as a function of the electrostatic capacity of the electrode pattern on the plate antenna PA is output to the apparatus main body A from the plate antenna PA and the analog voltage output from the detection circuit 37*a* of the residual amount detecting portion 37 is subjected to analog/digital conversion. The outcome of the analog/digital conversion is sent to an arithmetic circuit 37*b*, which changes the digital value into the amount of residual toner in the developing apparatus 4, by referring to a residual amount threshold value table 38. The signal representing the amount of residual toner is then transmitted to a central processing unit (CPU) that controls the image forming process so that the amount of residual toner may be displayed to the user in terms of % or the number of sheets that can be printed by the residual toner.

In this embodiment, the laser beam printer is adapted to operate in any of a plurality of image forming modes that can be selected by switching the amplitude of the AC voltage in the developing bias produced by superimposing the AC voltage on a DC voltage and applied to the developing sleeve 43. Image forming mode switching circuit 49 for switching the amplitude of the AC voltage of the bias according to the selected image forming mode is connected to the CPU and the developing bias source 35. A switching instruction is output from the image forming mode switch circuit 49 so that a bias that corresponds to the selected image forming mode is output from the developing bias source 35.

As shown in FIG. 3, the cartridge C of this embodiment has a memory device 25, which stores set values necessary for the image forming process including set values for the charging bias necessary for image formation, set values for the developing bias and set values for the rate of laser beam emission of the laser, which is the exposure means of the image forming apparatus, and the rates of consumption of consumables including the number of times of the use of the photosensitive drum 1 and the amount of residual toner in the developing apparatus 4. Particularly, the memory device 25 stores the outcome of detection of the amount of residual toner that relates to the number of sheets that can be printed of the cartridge C so that the user may be provided with information on the number of sheets that can be used for printing of the cartridge C, which may be used as an index for optimally forming images according to the history of use of the image forming apparatus.

In an image forming apparatus having the above-described configuration, there can arise a problem that the output value of the residual toner amount detection circuit for detecting the amount of residual toner in the developing apparatus by means of the developing bias can show discrepancies to consequently reduce the accuracy of detecting the amount of residual toner in addition to the problem that the area and the cost required for the necessary circuits will be significant when the amplitude of the AC voltage of the developing bias is switched according to the image forming mode selected according to the environment of installation and the amount of residual toner in the developing apparatus as pointed out above in the description of the prior art. For instance, the residual toner amount detection circuit may falsely detect a toner shortage situation due to a discrepancy between the detected amount of residual toner in the first image forming mode defined for a relatively large amount of residual toner and that of residual toner in the second image forming mode defined for a relatively small amount of residual toner in order to adapt the image forming apparatus to the environment when the first image forming mode is switched to the second image forming mode.

In view of the above-identified problem, this embodiment of image forming apparatus is adapted to correct the output value of the residual toner amount detection circuit according to the amplitude of the AC voltage of the developing bias in each image forming mode so that an output may be obtained accurately regardless of the amplitude of the AC voltage of the developing bias.

Now, the correcting operation of this embodiment will be described below by way of experiment examples.

Experiment Example 1

This experiment was conducted in an image forming apparatus according to the invention and having the above-described configuration. An image forming operation was repeated until the toner T contained in an initially full developer containing portion 40, or the toner containing portion 41 and the developing portion 42, was completely consumed and the amplitude of the AC voltage of the developing bias was switched from 2.0 KV to 2.5 KV when the amount of residual toner reached 20% of the total amount. The transition of the voltage was observed. The image forming conditions of this experiment are listed below.

1: The sheet passing speed was 30 spm (sheets per minutes). In other words, 30 sheets were made to pass continuously in a minute. Any two consecutive sheets were separated from each other by a gap equivalent to 0.5 seconds when sheets were made to pass continuously.

2: 10 seconds were spent as warming up time from the time when a printing instruction was received to the time when the printing operation was actually started. 5 seconds were spent as cooling time for an ending process after the end of the printing operation.

3: The number of revolutions per unit time of the agitating member 45 was set to 10 revolutions per minute so that toner T may dynamically circulate in the inside of the developer containing portion 40 of the developing apparatus 4. The agitating member 45 was prepared by using a 0.5 mm thick PET sheet in order to provide it with an appropriate degree of rigidity.

4: 1,000 g of toner was filled in the developer containing portion 40 and this state was defined as a full.

5: The position of the plate antenna PA was so adjusted in the developing apparatus 4 that the electrostatic capacity between the developing sleeve 43 and the plate antenna PA was 2 pF when the inside of the developer containing portion 40 was completely out of toner T and the electrostatic capacity was 6 pF when the inside of the developer containing portion 40 was full of toner T.

6: The amplitude of the AC voltage of the bias applied to the developing sleeve 43 was made equal to 2.0 KV when the surrounding environment showed a steady temperature and a steady humidity. The amount of residual toner detection circuit 37*a* was so designed that a voltage of 3 V was produced in the circuit when the electrostatic capacity was 2 pF to show that the inside of the developer containing portion 40 was completely out of toner T and a voltage of 2 V was produced in the circuit when the electrostatic capacity was 6 pF to show that the inside of the developer containing portion 40 was full of toner T.

7: 2.0 V, 2.36 V, 2.45 V and 3.0 V were defined as threshold voltage respectively for 50%, 25%, 20% and 0% of the amount of residual toner so that a warning is issued when any of the threshold values was exceeded.

Experiment 1

Firstly, an experiment of switching the amplitude of the AC voltage of the developing bias over a plurality of values and detecting the amount of residual toner without any correcting process will be described below as a comparative example.

Figure 4:
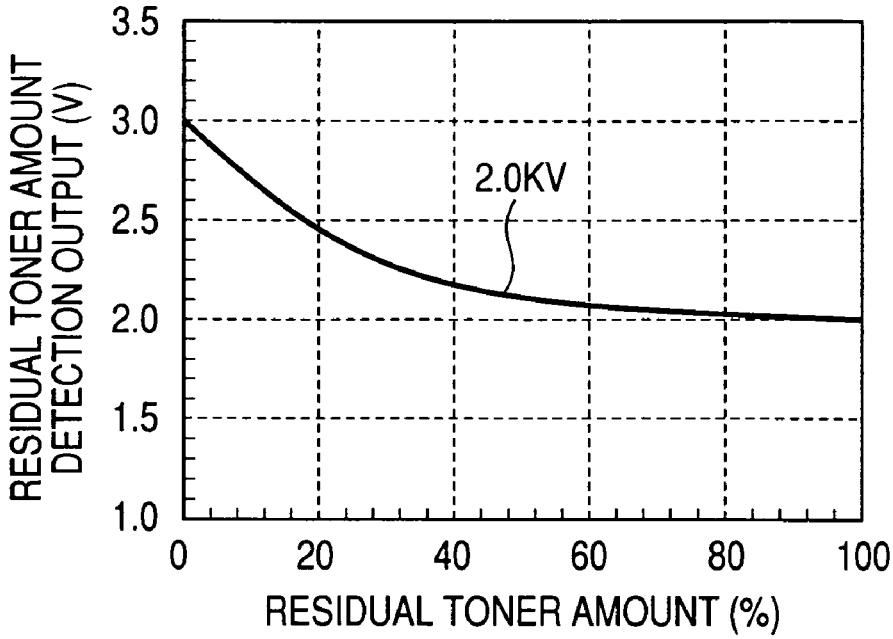
FIG. 4 is a graph illustrating the relationship between the amount of residual detector and the output value on the amount of residual developer when the amplitude of the AC voltage of the bias for detecting the amount of residual developer is 2.0 KV.

As for the transition of the amplitude of the AC voltage of the developing bias from the time when it showed 2.0 KV to the time when the developer containing portion 40 was completely out of toner T as observed on the above-described arrangement, it will be seen from FIG. 4 that the output voltage changed gradually as the amount of residual toner in the developing apparatus 4 decreased.

Figure 5:
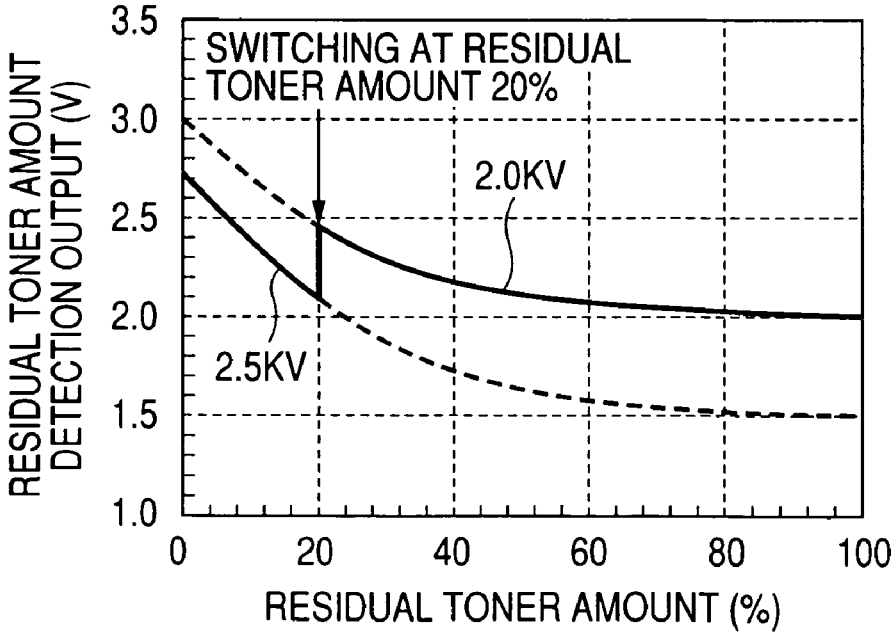
FIG. 5 is a graph illustrating the change in the detected value of the amount of residual developer that is uncorrected when the amplitude of the AC voltage of the bias for detecting the amount of residual developer is switched.

When the transition of the detected amount of residual toner, in which the amplitude of the AC voltage of the developing bias was switched to 2.5 KV at the time when the amount of residual toner was 20%, is overlapped on the graph illustrated in FIG. 4 as shown in FIG. 5, it will be seen that the detected amount of residual toner shows a large discrepancy before and after the switch like the one described earlier for the prior art.

Additionally, when the amplitude of 2.5 KV was used for the AC voltage, the warning display at the threshold value defined for 2.0 KV showed a large discrepancy.

Table 1 below shows the developer content (content ratio in terms of % relative to a situation where the developing apparatus was filled with 1,000 g toner) of the developing apparatus 4 at the time of 20% warning and at the time of 0% warning in the image forming mode of using the amplitude of 2.0 KV and in the image forming mode of using the amplitude of 2.5 KV.

TABLE 1

| | warning | |
|---|---|---|
| amplitude | 20% | 0% |
| 2.0 KV | 20 | 0 |
| 2.5 KV | 8 | — |

(%)

As seen from Table 1, a warning to be issued to the user when the amount of residual toner is 20% was actually issued when the actual amount of residual toner was 8% to greatly damage the accuracy if the switch of the amplitude of the AC voltage of the developing bias was not corrected.

In other words, it was found that the warning system of the comparative example was far from accurate and reliable, and defective images can easily be formed with such a warning system unless the detected amount of residual toner is corrected.

Experiment 2

In view of the above-identified problem, it was so arranged in this experiment that the amplitude of the AC voltage of the developing bias was switched to 2.5 KV in a situation where the amount of residual toner is equal to or less than 20% in a hot and humid environment of the image forming apparatus. This arrangement is selected in order to prevent the optical density of image from falling in a situation where the amount of residual toner is smaller in a hot and highly humid environment as pointed out above. As seen from the graph of FIG. 5, the difference of the value of the amount of residual toner as detected when the amplitude of the AC voltage is 2.0 KV and that of the amount of residual toner as detected when the amplitude of the AC voltage is 2.5 KV was read and the output value for the amount of residual toner is corrected by the difference, or 0.35 V.

Referring to the graph of FIG. 5, the output value, when the amplitude of the AC voltage is 2.0 KV, is 2.45 V at the point where the amount of residual toner is 20% but falls to 2.1 V when the amplitude of the AC voltage is raised to 2.5 KV. Therefore, the corrective value of 0.35 V is added to the output value of 2.1 V when the amplitude of the AC voltage is 2.5 KV. Then, the corrected output value becomes equal to 2.45 V when the amplitude of the AC voltage is 2.5 KV. The net result of the correction is that the corrected output value is very close the output value of 2.45 V when the amplitude of the AC voltage is 2.0 KV.

Figure 6:
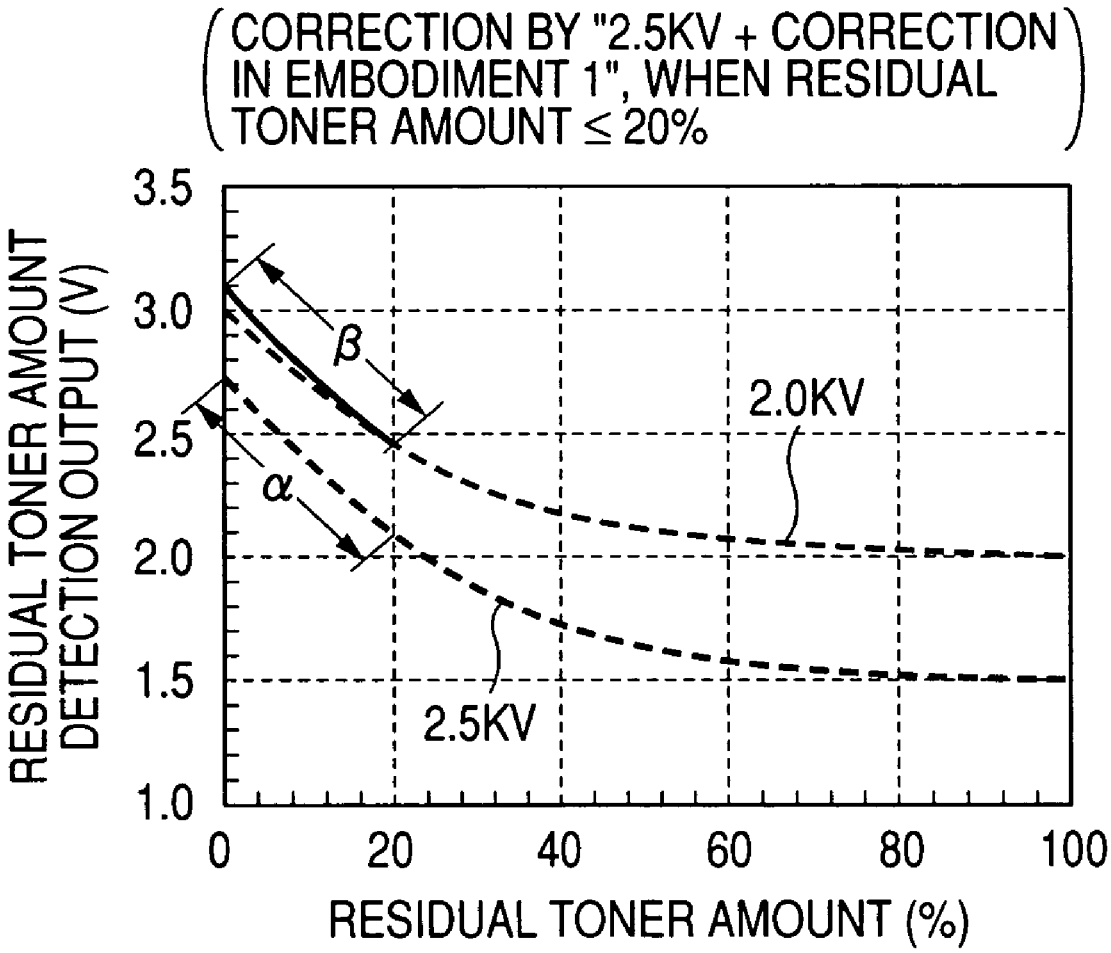
FIG. 6 is a graph illustrating the change in the detected value of the amount of residual developer that is corrected when the amplitude of the AC voltage of the bias for detecting the amount of residual developer is switched.

FIG. 6 is a graph in which the solid line shows the detected amount of residual toner when the output voltage is corrected along the entire transition thereof. More specifically, after a switch that was made when the amount of residual toner is 20%, the corrective value of 0.35 V is added to the detected value a that is detected when the amplitude is 2.5 KV. With this arrangement, the transition P that is observed when the amplitude of the AC voltage is 2.5 KV becomes very close to the transition that is observed when the amplitude of the AC voltage is 2.0 KV (dotted light line in FIG. 6).

Table 2 below shows the actual developer content (content ratio in terms of % relative to a situation where the developing apparatus was filled with 1,000 g toner) of the developing apparatus 4 at the time of 20% warning and at the time of 0% warning. As seen from Table 2, when the above-described corrective measure was taken, it is possible to maintain a high degree of accuracy by adding an appropriate corrective value to the output value even when the amplitude of the AC voltage is to be switched from 2.0 KV to 2.5 KV and vice versa.

TABLE 2

| | warning | |
|---|---|---|
| amplitude | 20% | 0% |
| 2.0 KV | 20 | 0 |
| 2.5 KV | 19 | 4 |

(%)

Figure 7:
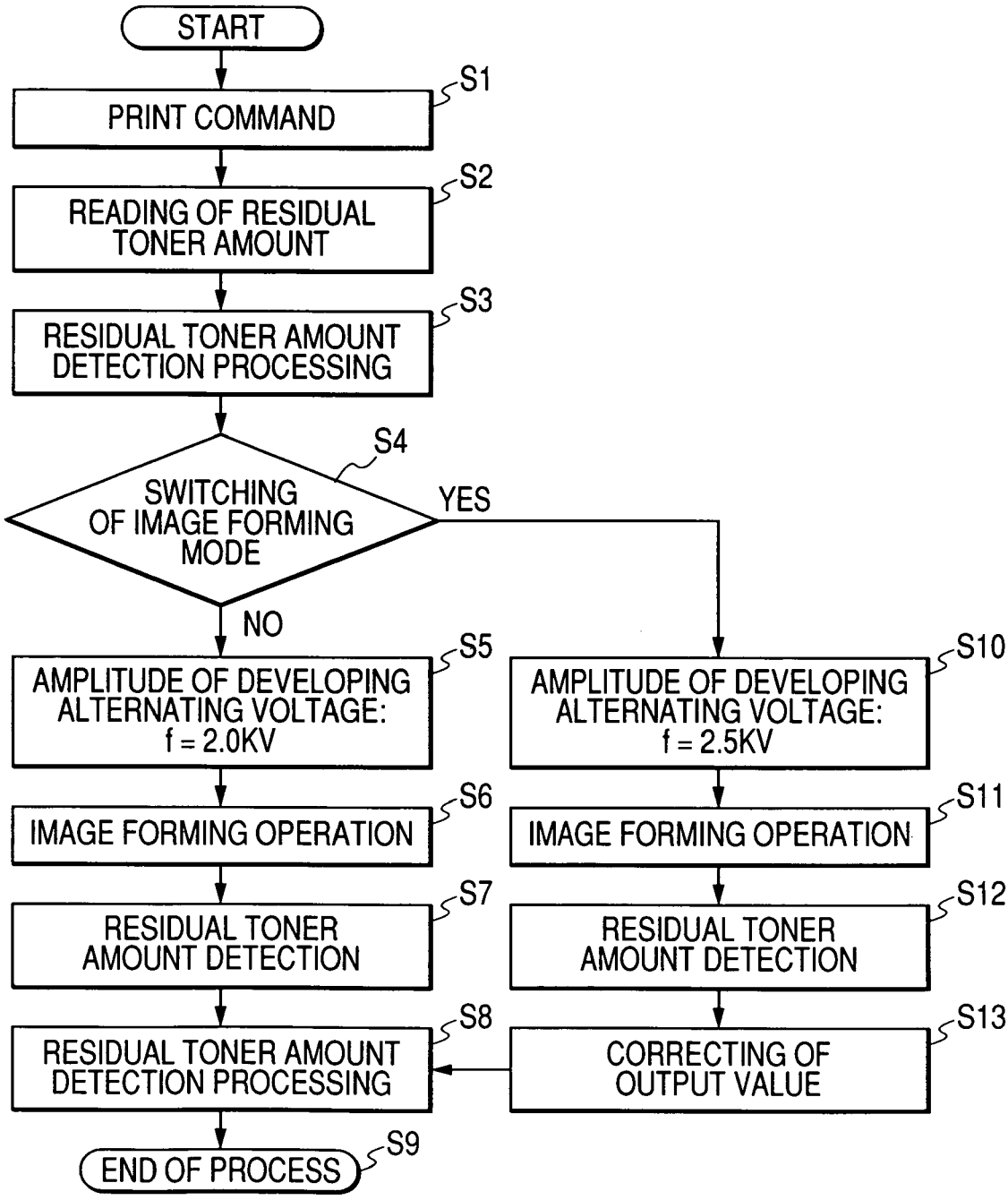
FIG. 7 is a flow chart of an image forming operation that can be used for the purpose of the present invention.

The operation for correcting the detected value of the amount of residual toner of this embodiment is conducted by following the flow chart of FIG. 7.

As a printing instruction is issued by the user (S1), the image forming apparatus reads out the information on the current amount of residual toner in the developing apparatus 4 (the output values from the PA) from the memory device 25 of the cartridge C and the printer main body A (S2). Then, the image forming apparatus executes an amount-of-residual-toner detecting process on the basis of the information (S3). More specifically, when the amount of residual toner is remarkably small, the image forming apparatus issues a warning to the user and selects an image forming mode that can acquire the best output.

Then, the image forming apparatus determines if the timing for a switch of image forming mode is specified by the user or an automatic switch of image forming mode is specified by the user or not (S4).

If nothing is specified (S4: NO), the image forming apparatus does not switch the current image forming mode. It then uses 2.0 KV for the amplitude of the AC voltage of the developing bias (S5) and performs an image forming operation (S6).

The amount of residual toner is detected for the amplitude of 2.0 KV of the AC voltage of the developing bias simultaneously with the image forming operation (S7) and an amount-of-residual-toner detecting process is executed according to the obtained output value (S8). If the amount of residual toner is found to be very small according to the outcome of the computational process for detecting the amount of residual toner, the image forming apparatus issues a warning to the user for the reduced amount of residual toner.

After the end of the sequence of operations, information on the amount of residual toner and the history of passing sheets is written in the memory device 25 to end the process (S9).

If, on the other hand, the timing for a switch of image forming mode is specified (S4: YES), the image forming apparatus switches the image forming mode to select 2.5 KV for the amplitude of the AC voltage of the developing bias (S10) and performs an image forming operation (S11).

An operation of detecting the amount of residual toner for the amplitude of 2.5 KV of the AC voltage of the developing bias is conducted simultaneously with the image forming operation (S12) and the obtained output value is appropriately corrected (S13). Then, the amount of residual toner is detected from the corrected output value (S8). The entire process ends after the sequence of operations (S9).

While the amount of residual toner is detected in S2 and the judgment for switching the image forming mode is made in S4 in the flowchart of FIG. 7, it may alternatively be so arranged that the temperature and the humidity are observed in S2 and the image forming mode is automatically switched in S4 depending on the environmental conditions determined in S2.

When the amplitude of the AC voltage is switched depending on the surrounding environment and/or the amount of residual toner as in this example, it is possible to maintain an enhanced level of accuracy of detection of the residual amount and provide the highest image quality by correcting the amount of residual toner as detected by means of the amplitude of the AC voltage depending on the amplitude of the AC voltage.

It should be noted here that the sizes, the materials, the shapes and the relative positions of the components of the image forming apparatus as cited above do not limit the scope of the present invention unless specifically described otherwise.

While an arrangement for detecting the amount of residual toner by correcting the detected value is described above, it is also possible to provide a plurality of detection circuits and use them selectively according to the selected amplitude of the AC voltage to obtain appropriate detection outputs.

Figure 16:
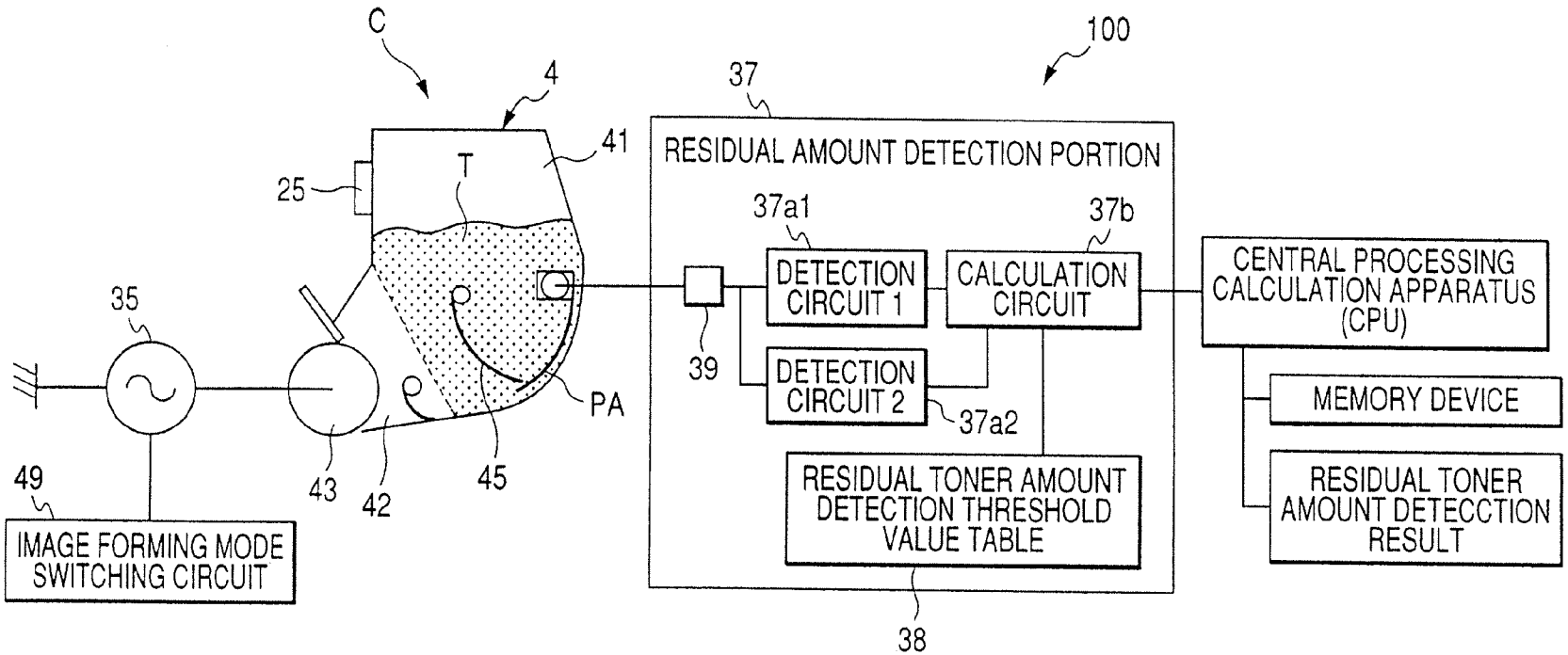
FIG. 16 is a schematic circuit diagram of means for detecting the amount of residual developer with a plurality of detection circuits that can be used for the purpose of the present invention.

FIG. 16 is a schematic circuit diagram of an arrangement means for detecting the amount of residual developer with a pair of detection circuits. When such an arrangement is applied to this example, it is controlled in such a way that the first detection circuit, denoted by reference symbol 37*a*1, is selected when the amplitude of the AC voltage is 2.0 KV and the second detection circuit, denoted by reference symbol 37*a*2, is selected when the amplitude of the AC voltage is 2.5 KV by means of a selection circuit 39. Since the arrangement of FIG. 16 is the same as that of FIG. 3 except for the detection circuits and the selection circuit, it will not be described here any further.

While only 2.0 KV and 2.5 KV are used for the amplitude of the AC voltage in this example, the present invention is by no means limited thereto. While an arrangement for using two different amplitudes of the AC voltage is described above, the present invention is by no means limited thereto and, if it is necessary to use more values for the amplitude of the AC voltage, more corrections will be made to those values to detect the amount of residual toner accurately.

For switching the image forming mode, it is possible to make the user directly specify a mode to the apparatus main body or have the apparatus main body detect the surrounding environment and automatically switch the image forming mode according to the detected environmental conditions.

While an arrangement for switching the image forming mode as a function of the surrounding environment is described above for the embodiment, the present invention is by no means limited thereto. For example, if an image is obtained with the best image quality by using 2.0 KV, there may come a time when the use of 2.5 KV for the amplitude of the AC voltage of the developing bias provides a better image quality regardless of the surrounding environment because of degradation of the developer and the members of the developing apparatus in the latter stages of service life of the embodiment. Additionally, there may be occasions where the use of 2.5 KV provides a better image quality regardless of the amount of residual toner. An arrangement for switching the image forming mode and correcting the detected amount of residual toner is effective even in such occasions.

While the image forming mode is switched by shifting the amplitude of the AC voltage of the developing bias in order to achieve the highest image quality in this embodiment, the present invention is by no means limited thereto and it is effective to use the technique of shifting the amplitude of the AC voltage of the developing bias and a technique of changing the process speed in combination in order to achieve a high precision image.

The configuration of an image forming apparatus according to the invention and the structure of the cartridge to be used for the image forming apparatus are by no means limited to those described above.

An image forming apparatus according to the invention may be adapted to use a plurality of cartridges, the respective developing apparatus of which may contain developers of different colors to make the apparatus a color image forming apparatus. An image forming apparatus according to the invention may comprise an intermediate transfer member. While the developer of this embodiment is a negatively charged one-component magnetic toner, it may alternatively be a non-magnetic toner, a two-component developer or a positively charged toner.

Embodiment 2

A single plate antenna (PA) is arranged in the developing apparatus 4 as electrode for detecting the amount of residual toner in the above description of the first embodiment. However, as large capacity toner cartridges are used for image forming apparatus in these days, developing apparatus comprising a plurality of plate antennas PA for detecting the amount of residual toner are becoming popular. Additionally, when a plurality of plate antennas PA are arranged in a developing apparatus, an arrangement of differentiating the ranges of measurement of the amount of residual toner to which the plate antennas PA are respectively responsible are advantageously used.

For example, there may be arranged a plate antenna PA2 for highly accurately detecting the amount of residual toner from 40% to 10% and another plate antenna PA1 for highly accurately detecting the amount of residual toner from 10% to 0% to divide the rage of measurement.

For the purpose of dividing the range of measurement, the positions of the plate antennas PA may be separated from each other in such a way that one of the plate antennas PA is arranged at a position suitable for detecting the amount of residual toner in a larger range while the other plate antenna PA is arranged at a position suitable for detecting the amount of residual toner in a smaller range.

However, when arranging a plurality of plate antennas PA, the electrostatic capacity may vary depending on the plate antenna PA that is actually put to use. Then, if the amplitude of the AC voltage of the developing bias is changed for each image forming mode, the variation in the detection output of the residual amount due to the change in the amplitude of the AC voltage of the developing bias varies among the plate antennas PA so that a specific amount of correction has to be provided for each plate antenna PA.

Thus, the developing apparatus 4 of this embodiment is provided with a plurality of plate antennas PA and each of the output values obtained by means of the plurality of plate antennas PA is corrected in a specific appropriate way depending on the amplitude of the AC voltage of the developing bias when the amplitude of the AC voltage is switched according to the selected image forming mode.

Figure 8:
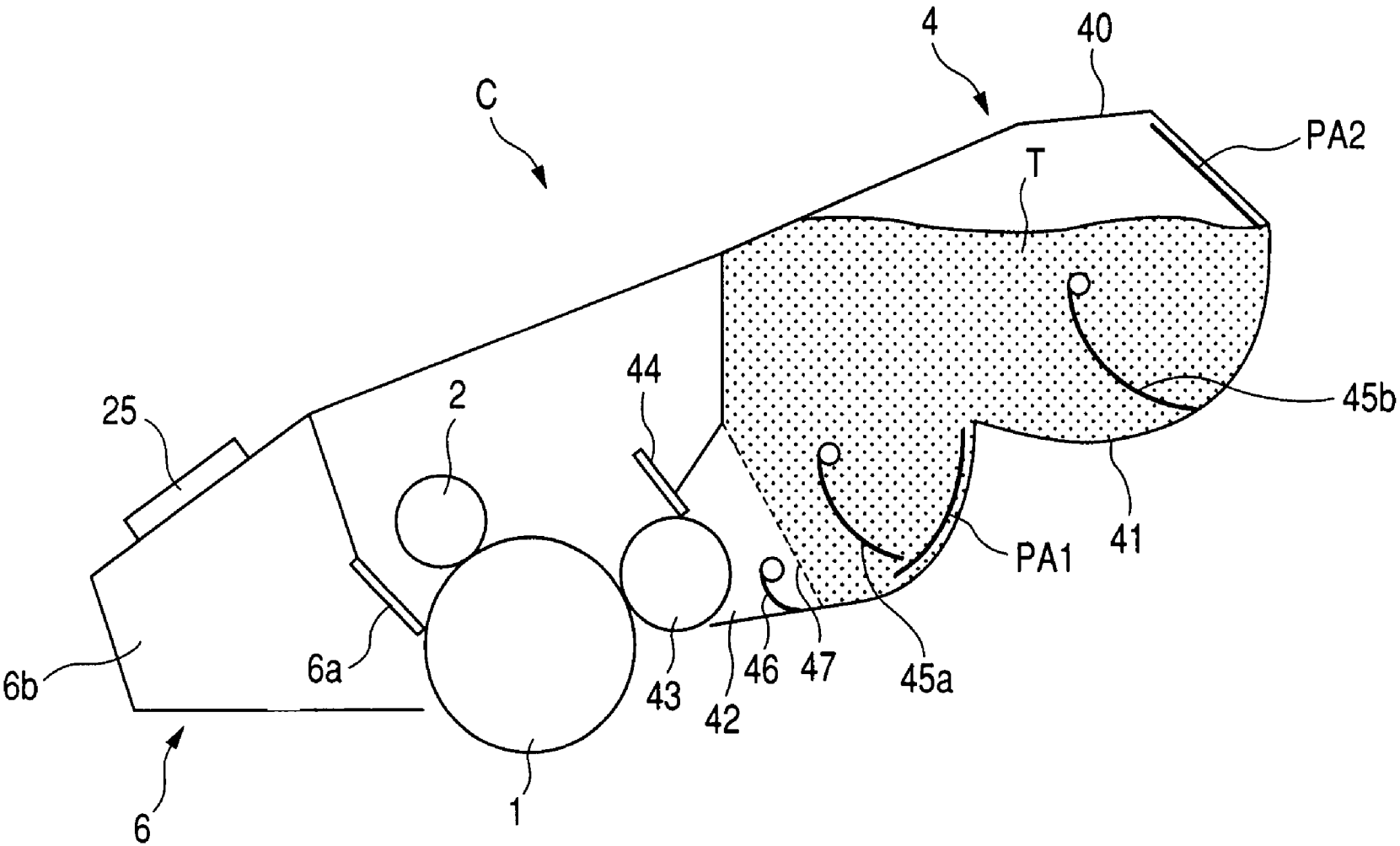
FIG. 8 is a schematic illustration of another process cartridge that can be used for the purpose of the present invention.

As shown in FIG. 8, plate antennas PA1 and PA2 are arranged in the toner containing portion 41 as electrode members of the means for detecting the amount of residual developer 100 so as to form a capacitor structure with the developing sleeve 43 in the toner containing section 41 in this embodiment and toner is stored in the spaces respectively defined by the developing sleeve 43 and the plate antennas PA1, PA2. In this embodiment, two agitating members 45*a*, 45*b* are arranged in the toner containing section 41 in order to mobilize toner. In other words, the number of agitating members is larger by one than the number of agitating members of the first embodiment.

The technique and the process of arranging the plate antennas and electrically energizing them are the same as those described above by referring to the first embodiment and hence will not be described here any further.

The plate antennas PA1, PA2 operate with the developing sleeve 43 to measure the amount of residual toner by detecting the dielectric voltages induced respectively by the developing biases applied to the developing sleeve 43.

Figure 9:
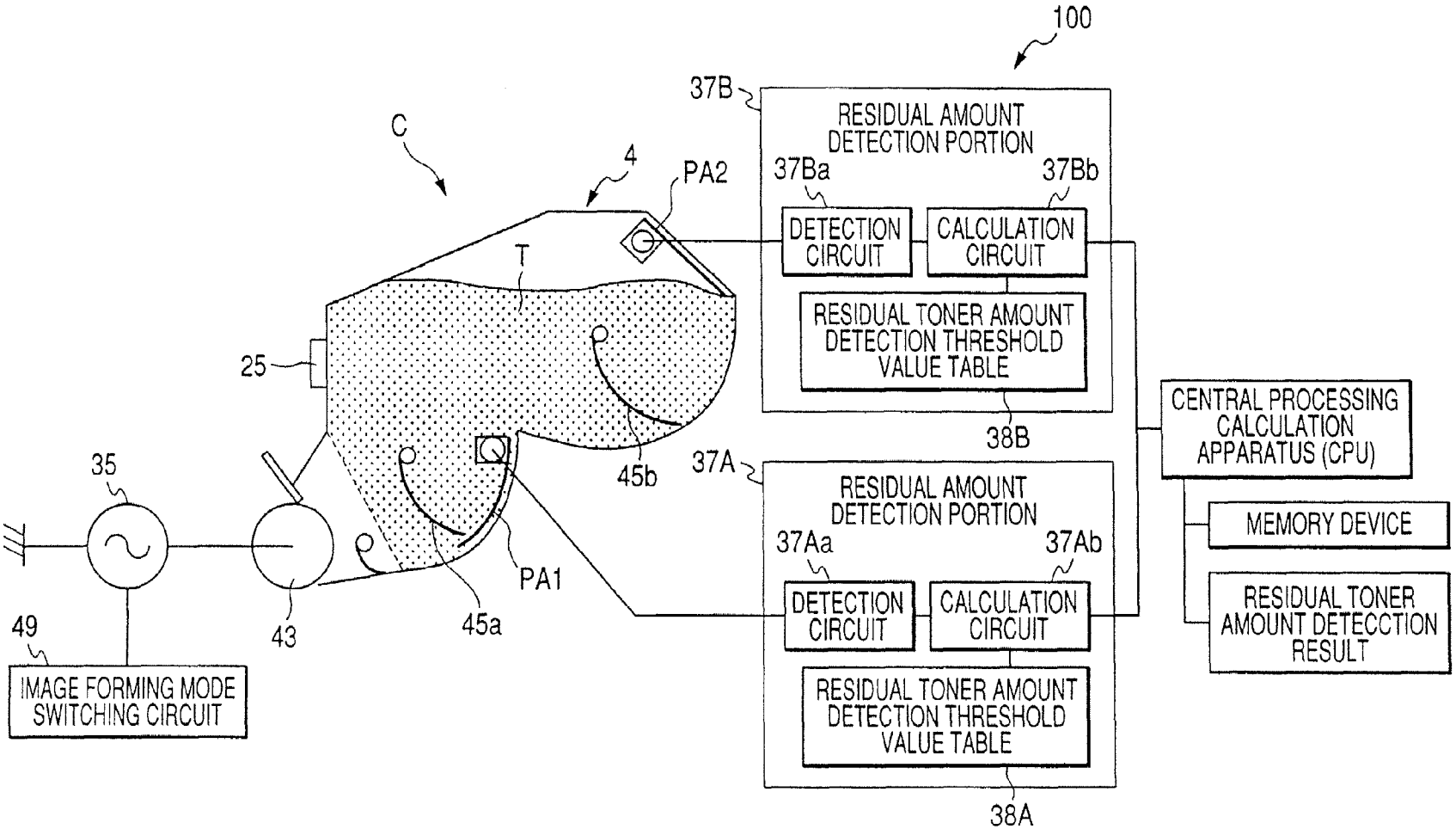
FIG. 9 is a schematic circuit diagram of another means for detecting the amount of residual developer.

As shown in FIG. 9 of a schematic circuit diagram of the means for detecting the amount of residual developer 100, the signal values obtained by the two plate antennas PA1, PA2 are transmitted to respective toner residual amount detecting portions 37A, 37B arranged for the respective plate antennas for a processing operation.

The voltage value produced by the PA2 is output to the circuit 37B arranged in the apparatus main body A and dedicated to the PA2 and subjected to digital conversion at detection circuit 37Ba. Then, it is compared with residual toner amount detection threshold value table 38B dedicated to the PA2 by arithmetic circuit 37Bb and the outcome of comparison is notified to the user as the outcome of detection of the amount of residual toner.

The toner residual amount detecting portion 37A of the plate antenna PA1 operates just like the toner residual amount detecting portion 37B of the plate antenna PA2.

Of the two plate antennas PA1, PA2, the output obtained from the plate antenna PA2 that is remote from the developing sleeve 43 is used to detect the amount of residual toner of the cartridge C in a former half of the residual toner detecting operation (from 40% to 10% of residual toner), whereas the output obtained from the plate antenna PA1 that is close to the developing sleeve 43 is used to detect a latter half of the residual toner detecting operation (from 10% to 0% of residual toner).

An experiment similar to Experiment 1 of Embodiment 1 was conducted by using this embodiment of image forming apparatus comprising a process cartridge C1 having a configuration as shown in FIG. 8 and means for detecting the amount of residual developer 100 having a configuration as shown in FIG. 9.

Experiment Example 2

Of the two toner residual amount detecting portions 37A, 37B, the plate antenna PA1 that is close to the developing sleeve 43 is arranged in such a way that the electrostatic capacity is 2 pF when the toner containing portion is completely out of toner and 6 pF when the toner containing portion is full of toner. On the other hand, the plate antenna PA2 that is remote from the developing sleeve 43 is arranged in such a way that the electrostatic capacity is 3 pF when the toner containing portion is completely out of toner T and 1 pf when the toner containing portion is full of toner T.

Additionally, the toner residual amount detection circuits 37Aa, 37Ba are so adjusted that the voltage values that arises at the respective circuits are equal to 3 V when the toner containing portion is completely out of toner T and 2 V when the toner containing portion is full of toner T for the plate antennas PA1, PA2, provided that the amplitude of the AC voltage of the developing bias is 2.0 KV.

Figure 10:
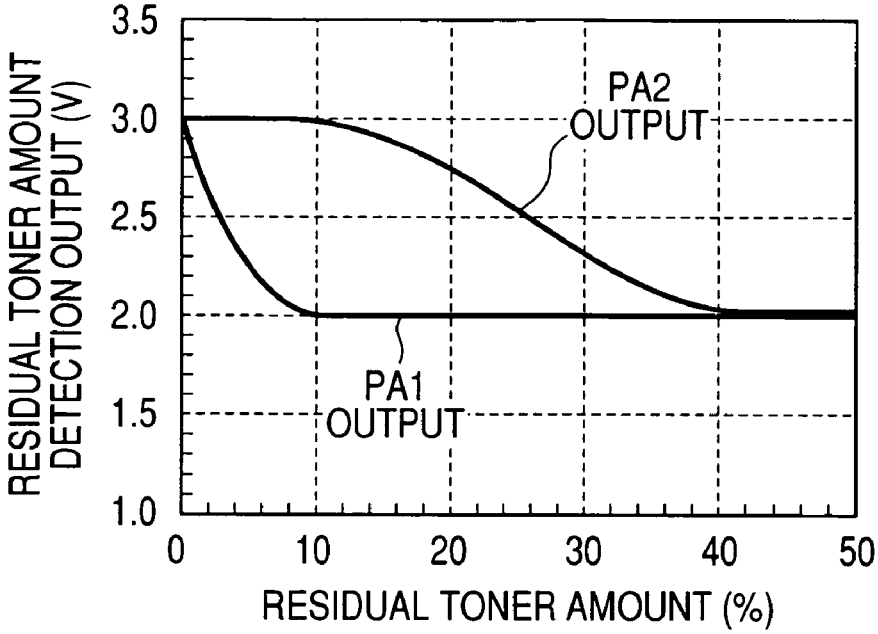
FIG. 10 is a graph illustrating the relationship between the amount of residual developer and the output value on the amount of developer as detected by two electrodes.

FIG. 10 is a graph illustrating the relationship between the amount of residual developer and the output value on the amount of developer as detected by the plate antennas PA1 and PA2 when the amplitude of the AC voltage of the developing bias is 2.0 KV. It will be seen from FIG. 10 that the plate antenna PA2 and the plate antenna PA1 can appropriately detect the amount of residual toner in the cartridge C respectively in a former half of the service life of the cartridge C and in a latter half of the service life of the cartridge C.

Figure 11:
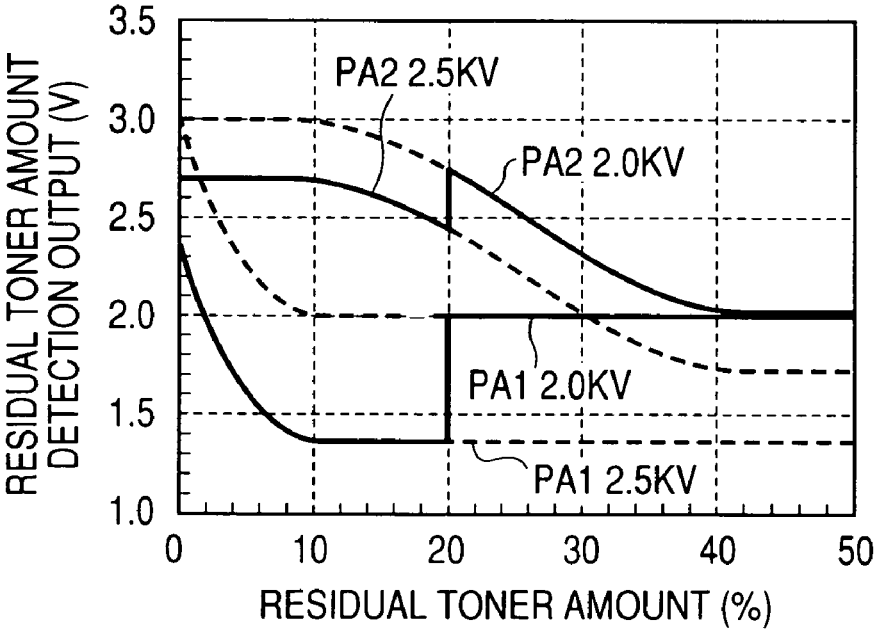
FIG. 11 is a graph illustrating the change in the detected value of the amount of residual developer as detected by two electrodes but uncorrected when the amplitude of the AC voltage of the bias for detecting the amount of residual toner is switched.
Figure 12:
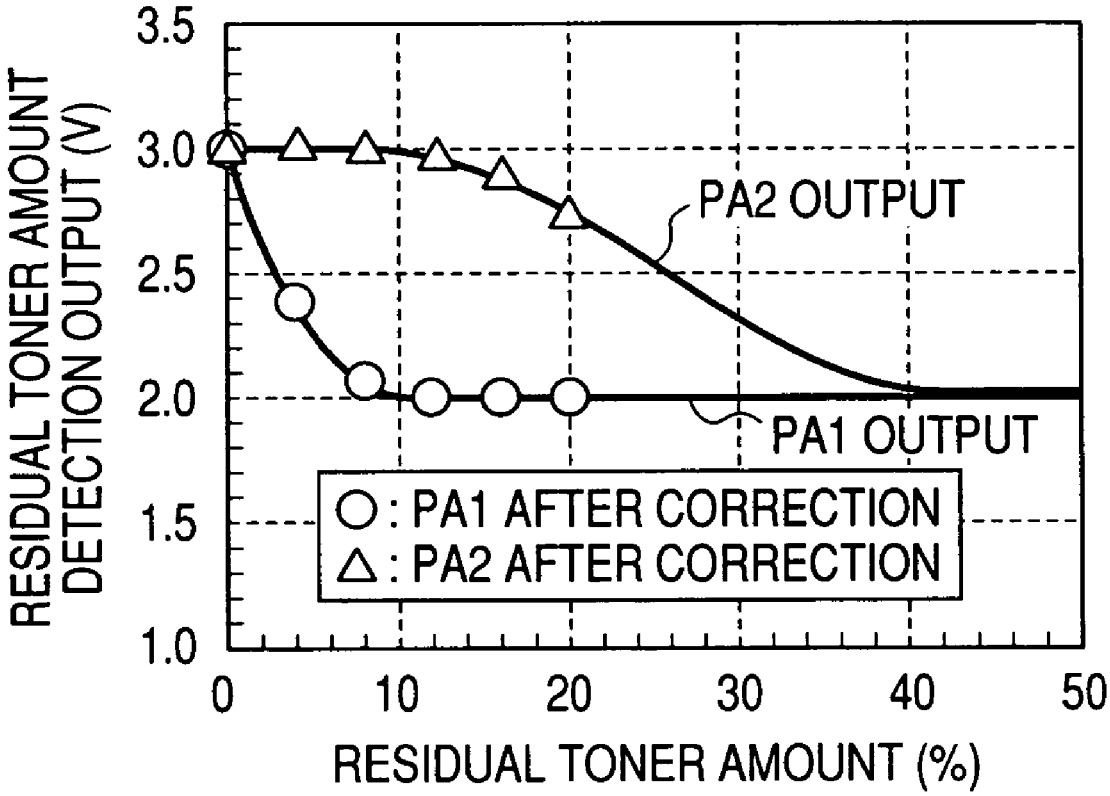
FIG. 12 is a graph illustrating the change in the detected value of the amount of residual developer as detected by two electrodes and corrected when the amplitude of the AC voltage of the bias for detecting the amount of residual toner is switched.

In the configuration of this embodiment, when the amplitude of the AC voltage of the bias for detecting the amount of residual toner is switched from 2.0 KV to 2.5 KV, as shown in FIG. 11, a change occurs with both the plate antenna PA1 and the plate antenna PA2.

However, when looking into the difference in the detected value of the amount of residual toner between 2.0 KV and 2.5 KV, it will be seen that it is about 0.6 V for the plate antenna PA1 and about 0.3 V for the plate antenna PA2 to give rise to a difference between the two antennas PA1 and PA2. In other words, when the correcting process that is optimal to either the plate antenna PA1 or the plate antenna PA2 is applied to the other plate antenna, the plate antenna PA1 or the plate antenna PA2, whichever is appropriate, the outcome of detection of the amount of residual toner by the latter plate antenna obviously involves a large error.

Thus, optimal correction processes are applied independently to the respective plate antennas PA1 and PA2. Additionally, the correction process is executed when the amount of residual toner is not higher than 20%, while amplitude of the AC voltage of the developing bias is changed depending on the amount of residual toner that is being detected.

Table 3 shows the values to be used for correction for both the plate antenna PA1 and the plate antenna PA2.

TABLE 3

| | | toner residual | |
|---|---|---|---|
| Amplitude | amount electrode | 20-10 (%) | 10-0 (%) |
| at 2.5 KV | PA1 | 0.59 V | 0.58 V |
| | PA2 | 0.28 V | 0.27 V |

Residual toner amount detection threshold value tables 38A, 38B were corrected with these values for correction and the experiment was conducted once again.

As a result, it was found that, when the amplitude of the AC voltage was switched from 2.0 KV to 2.5 KV, the output value of detecting the amount of residual toner substantially agrees with the output value obtained with the amplitude of 2.0 KV for both the plate antenna PA1 and the plate antenna PA2.

Figure 13:
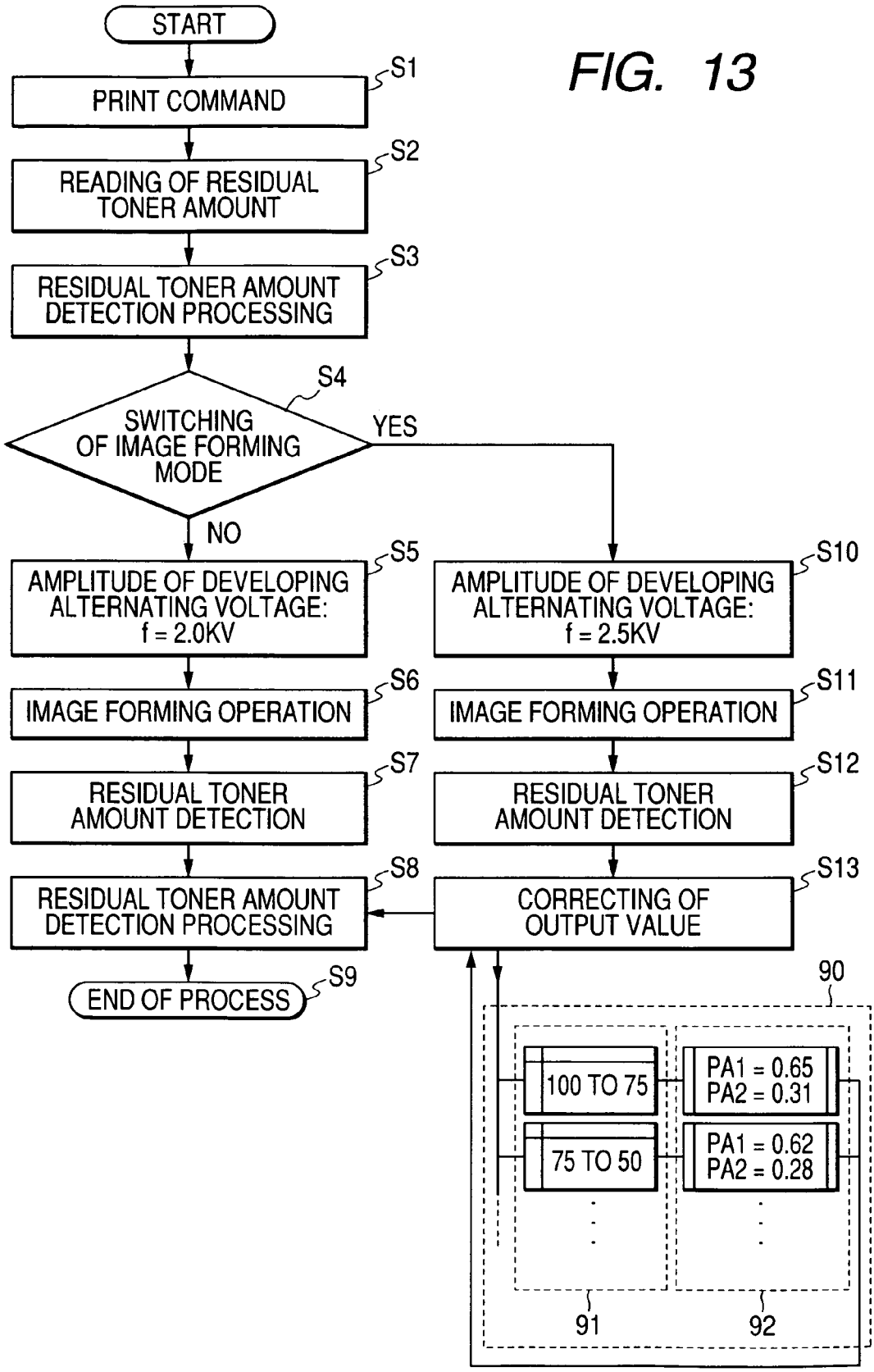
FIG. 13 is another flow chart of an image forming operation that can be used for the purpose of the present invention.
Figure 14:
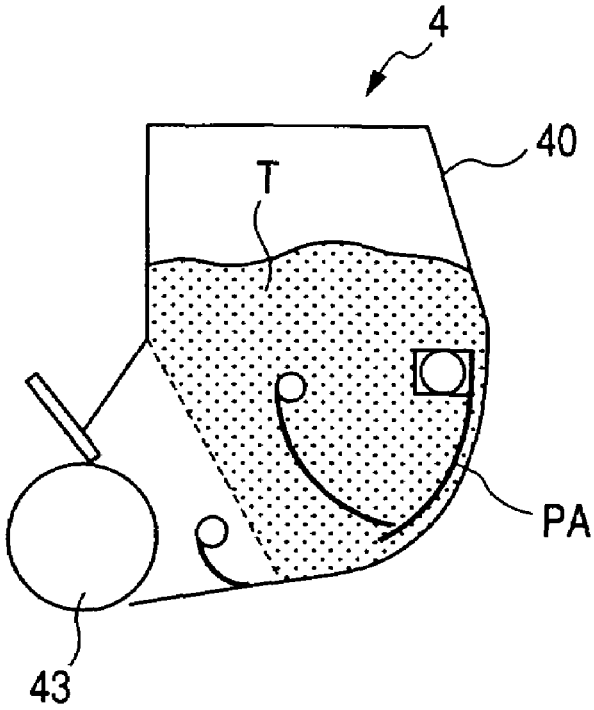
FIG. 14 is a schematic cross sectional view of a known developing apparatus.
Figure 15A:
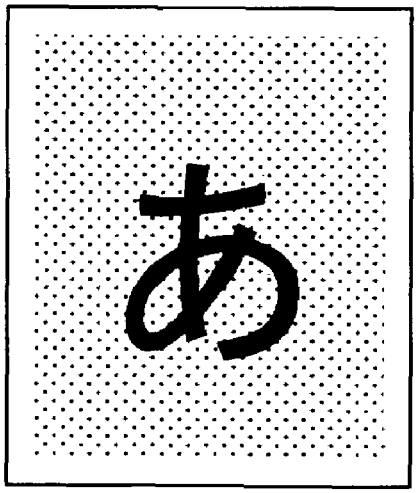
FIGS. 15A and 15B are schematic illustrations of a "fogged" state of a formed image.
Figure 15B:
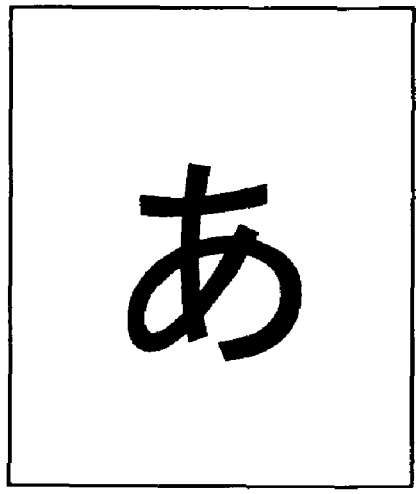

Now, the operation of this embodiment will be described below by referring to the flow chart of FIG. 13. The steps that are the same as those of the first embodiment will be described only briefly for the purpose of simplicity.

As a printing instruction is issued by the user (S1), the image forming apparatus reads out the information on the current amount of residual toner (S2) and subsequently executes an amount of residual toner detecting process (S3).

Then, the image forming apparatus determines if the timing for an image forming mode switch is specified by the user or an automatic image forming mode switch is specified by the user or not (S4).

If nothing is specified (S4: NO), the image forming apparatus does not switch the current image forming mode. It then uses 2.0 KV for the amplitude of the AC voltage of the developing bias applied to the developing sleeve 43 (S5) and performs an image forming operation (S6).

The amount of residual toner is detected for the amplitude of 2.0 KV of the AC voltage of the developing bias simultaneously with the image forming operation (S7) and an amount of residual toner detecting process is executed according to the obtained output value (S8). After the end of the sequence of operations, information on the amount of residual toner and the history of passing sheets is written in the memory device 25 of the cartridge C to end the process (S9).

If, on the other hand, the timing for an image forming mode switch is specified (S4: YES), the image forming apparatus switches the image forming mode to select 2.5 KV for the amplitude of the AC voltage of the developing bias (S10) and performs an image forming operation (S11).

An operation of detecting the amount of residual toner for the amplitude of 2.5 KV of the AC voltage of the developing bias is conducted simultaneously with the image forming operation (S12).

The obtained outcome of the operation of detecting the amount of residual toner is compared with a threshold table 91 for each amount of residual toner in the current cartridge residual amount output correction table 90 and the outputs of the residual toner amount detection threshold value tables 38A, 38B are corrected by using the respective values 92 defined for correction of the plate antennas PA1, PA2 that are related to the threshold table 91 (S13). Then, the amount of residual toner is detected from the corrected output value (S8). The entire process ends after the sequence of operations (S9).

While the amount of residual toner is detected in S2 and the judgment for switching the image forming mode is made in S4 here again, it may alternatively be so arranged that the temperature and the humidity are observed in S2 and the image forming mode is automatically switched in S4 depending on the environmental conditions determined in S2.

With this arrangement where a plurality of electrodes are provided to detect the amount of residual toner and each of them are used, it is possible to maintain the accuracy of detection of the amount of residual toner when the amplitude of the AC voltage of the developing bias is switched by correcting the respective outcomes of detection.

While two detection circuits are used in this embodiment, the number of detection circuits is by no means limited to two. A plurality of detection circuits may be provided for so many amplitudes of AC voltage to be used for each plate antenna. Then, the detection circuits may selectively be used depending on the amplitude to output correct detection output values as in the first embodiment. With such an arrangement, it is not necessary to correct the above-described output. Additionally, while a correction is made to the outcome of detection of the amount of residual toner by every 20% range in the first and second embodiments, the present invention is by no means limited to such a range. The amount of residual developer can be detected effectively and more accurately when a smaller range is used.

Thus, with the above-described embodiments, it is possible to raise the degree of accuracy of detection of the amount of residual developer by providing a plurality of image forming modes that are to be selectively used to switch the amplitude of the AC voltage of the developing bias in accordance with the function of the surrounding environment and the amount of residual toner in the developing apparatus and correcting the output value of detection of the amount of residual developer at the time of every switch so that the output value may not vary depending on the image forming mode.

Additionally, with the above-described embodiments, it is possible to accurately detect the amount of residual developer and maintain the quality of the formed images at a high level if the amplitude of the AC voltage of the developing bias that is applied to the developer carrying member is changed according to the surrounding environment and the amount of residual developer.

The present invention is by no means limited to the above-described embodiments, which may be modified and altered appropriately without departing from the scope of the present invention.

This application claims priority from Japanese Patent Application Nos. 2004-289220 filed Sep. 30, 2004 and 2005-262974 filed on Sep. 9, 2005, which are hereby incorporated by reference herein.

What is claimed is:

1. An image forming apparatus which can change an AC voltage to be applied to a developer carrying member for carrying developer contained in a developing container, said apparatus comprising:

a plurality of developer detecting portions configured and positioned to detect a value corresponding to the amount of developer in the developer container;

a processing portion configured and positioned to determine the amount of developer in the developer container according to the value when the AC voltage is applied to the developer carrying member; and an image forming portion configured and positioned to form an image with the developer stored in the developing container, wherein said apparatus is configured to change the AC voltage to a first AC voltage and a second AC voltage, and wherein, when the AC voltage is the first AC voltage, said processing portion selects one of said plurality of developer detecting portions and determines the amount of developer in the developer container according to the value detected by said selected developer detecting portion and when the AC voltage is changed to the second AC voltage, said processing portion selects one of said plurality of developer detecting portions and corrects the value detected by selected developer detecting portion and determines the amount of developer in the developer container according to the corrected value.

2. The apparatus according to claim 1, wherein the amplitude of the first AC voltage differs from the amplitude of the second AC voltage, and wherein said processing portion changes the first AC voltage to the second AC voltage according to the environment surrounding the image forming apparatus.

3. The apparatus according to claim 1, wherein the amplitude of the first AC voltage differs from the amplitude of the second AC voltage, and wherein said processing portion changes the first AC voltage to the second AC voltage according to the amount of residual developer in the developer container.

4. The apparatus according to claim 1, wherein said image forming portion comprises an image bearing member configured and positioned to form an image on the surface thereof by means of the developer carrying member, wherein at least said image bearing member, the developer carrying member and the developer container being integrally combined to constitute a process cartridge, the process cartridge being detachably mountable to an image forming apparatus main body.

5. An image forming apparatus which can change an AC voltage to be applied to a developer carrying member for carrying developer stored in a developer container, said apparatus comprising:

a first detecting member configured and positioned to detect a first value corresponding to the amount of developer in the developer container;

a second detecting member configured and positioned to detect a second value corresponding to the amount of developer in the developer container;

a processing portion configured and positioned to determine the amount of developer in the developer container according to the value detected by said first detecting member or said second detecting member when the AC voltage is applied to the developer carrying member; and an image forming portion configured and positioned to form an image with the developer stored in the developing container, wherein said apparatus is configured to change the AC voltage to a first AC voltage and a second AC voltage, wherein, when the AC voltage is the first AC voltage, said processing portion selects one of said first detecting member and said second detecting member and determines the amount of developer in the developer container according to the value detected by selected detecting member, wherein, when the AC voltage is changed to the second AC voltage, said processing portion selects one of said first detecting member and said second detecting member and corrects the value detected by selected detecting member, and determines the amount of developer in the developer container according to the corrected value, and wherein a value to be used for correcting the first value detected by said first detecting member and a value to be used for correcting the second value detected by said second detecting member are different from each other.

6. The apparatus according to claim 5, wherein the amplitude of the first AC voltage differs from the amplitude of the second AC voltage, and wherein said processing portion changes the first AC voltage to the second AC voltage according to the environment surrounding said image forming apparatus.

7. The apparatus according to claim 5, wherein the amplitude of the first AC voltage differs from the amplitude of the second AC voltage, and wherein said processing portion changes the first AC voltage to the second AC voltage according to the amount of residual developer in the developer container.

8. The apparatus according to claim 5, wherein the range of the amount of residual developer to be detected by said first detecting member and the range of the amount of residual developer to be detected by said second detecting member are different from each other.

9. The apparatus according to claim 5, wherein said image forming portion comprises an image bearing member configured and positioned to form an image on the surface thereof by means of the developer carrying member, wherein at least said image bearing member, the developer carrying member and the developer container are integrally combined to constitute a process cartridge, the process cartridge being detachably mountable to an image forming apparatus main body.

* * * * *